US005538404A

United States Patent [19]

DiFlora et al.

[11] Patent Number: 5,538,404

[45] Date of Patent: Jul. 23, 1996

[54] COMPRESSOR UNIT SHELL CONSTRUCTION

[75] Inventors: Michael A. DiFlora, Bristol, Tenn.; David R. Gilliam, Bristol, Va.; Pransanta K. Roy; Prakash N. Pandeya, both of Bristol, Tenn.; Gordon T. Boyd, Abingdon, Va.; David T. Monk, Bristol, Tenn.

[73] Assignee: Bristol Compressors, Inc., Bristol, Va.

[21] Appl. No.: 405,687

[22] Filed: Mar. 17, 1995

Related U.S. Application Data

[63] Continuation-in-part of Ser. No. 796,953, Oct. 25, 1992, abandoned, and a continuation-in-part of Ser. No. 97,581, Jul. 27, 1993, abandoned.

[51] Int. Cl.[6] ..... F04B 39/00

[52] U.S. Cl. ..... 417/312; 181/200; 181/403

[58] Field of Search ..... 417/312, 902; 181/200, 202, 403

[56] References Cited

U.S. PATENT DOCUMENTS

| | | | |
|---|---|---|---|
| 2,928,589 | 3/1960 | Davey | 417/312 |
| 3,044,682 | 7/1962 | Weibel et al. | 417/902 |
| 3,187,992 | 6/1965 | Roelsgaard | 417/902 |
| 3,189,258 | 6/1965 | Larsen | 220/23.83 |
| 3,663,127 | 5/1972 | Cheers | 417/372 |
| 4,345,882 | 8/1992 | Saito et al. | 417/902 |
| 4,384,635 | 5/1983 | Lowery | 181/403 |
| 4,401,418 | 8/1983 | Fritchman | 417/312 |
| 4,410,303 | 10/1983 | Bar | 417/312 |
| 4,544,169 | 10/1985 | Cobb et al. | 277/235 B |
| 4,566,865 | 1/1986 | Nishitsuji et al. | 417/902 |
| 4,729,723 | 3/1988 | Outzen | 417/312 |
| 4,791,329 | 12/1988 | Ubukata et al. | 310/686 |
| 4,995,791 | 2/1991 | Loprete | 417/366 |
| 5,391,054 | 2/1995 | Bush | 415/182.1 |

*Primary Examiner*—Peter Korytnyk

[57] ABSTRACT

A shell for a hermetic compressor unit, the shell having a top section or dome, and a bottom section, the dome having a unique shape which gives enhanced capacity for absorbing and attenuating structural and fluid transmitted wave energies emanating from the unit at wave frequencies of between 1,000 Hz and 2,000 Hz, while reducing total operating noise of the unit, the dome being formed of sheet metal and having a generally inverted cup-shaped configuration with generally cylindrical sidewalls and a top wall having a central portion surrounded by a peripheral portion, wherein the sidewall taken in a generally axial direction is substantially straight, wherein the central portion of the top constitutes from about 40 to about 90% of the total area of the top and has a generally hemispherical configuration on a mean radius of from about 6.5 to about 10.0 inches as measured from an origin point $O_2$, and wherein the lower section of said shell has a generally cylindrical sidewall and an outwardly curved bottom wall of a generally hemispherical configuration, the ratio of the radius of curvature of the bottom wall to the diameter of the sidewall being from about 0.4 to about 2.0.

10 Claims, 4 Drawing Sheets

COMPRESSOR UNIT SHELL CONSTRUCTION

This application is a continuation-in-part of Ser. No. 07/796,953, filed Oct. 25, 1991 now abandoned, and of Ser. No. 08/097,581, filed Jul. 27, 1993, now abandoned.

FIELD OF INVENTION

The invention concerns refrigeration or air conditioning compressor units of the hermetically sealed type wherein the shell which contains the compressor and its drive motor is comprised of upper and lower cup shaped sections which, after the compressor and motor are mounted therein, are secured together, e.g., by welding along the peripheral mating joint formed by their contiguous open end portions.

It is customary in the design and manufacture of such compressors to dimension and configure these shell sections to adequately accommodate, spacewise, the compressor, its motor, and the various auxiliary components such as motor mounted, suction feed system, discharge loop, discharge muffler, and the like. Such design considerations are, of course important, however, other design needs such as diminishing the inherent property of the shell to transmit objectionable noise at objectionable frequencies are often comprised by the paramount space considerations, such as the dimensions and configuration of the refrigeration or air conditioning system housing or cabinet into which the compressor unit must precisely fit. Also, the manufacturing techniques such as deep-draw press operations require or at least prefer certain shell configurations such as straight, cylindrical side walls. Such being the case, vibrational characteristics become an inherent property of the side walls and can contribute to compressor noise.

DISCUSSION OF THE PRIOR ART

The patent literature shows many variations of compressor unit shell configurations, e.g., U.S. Pat. Nos. 4,239,461; 4,396,360; and 4,412,791 however, none of these patents appear to be concerned with objectionable noise transmitted by the shell and originating or propagated therein either by the mechanical elements of the compressor such as the suction and discharge valves, or by the liquid or gas refrigerant therein, e.g., pulsations within the suction or discharge system. In this regard, it is recognized by those skilled in the art that the source of the noise, its mode of propagation within the shell, and its manner of transmission by the shell to the human ear are all extremely difficult to understand and predict, and of course, to control.

Objects therefore, of the present invention are: to provide a compressor unit shell design which is configured to accommodate many types of presently manufactured compressors, single or multiple cylinders, most preferably two cylinders, including their motors and the aforesaid auxiliary components, which compressors are typically employed in hermetic units, while exhibiting the capacity for diminishing the levels of objectionable noise transmitted by or from the shell; to provide such a shell design, i.e., with substantially straight cylindrical side walls, which design is relatively inexpensive and easy to produce by conventional metal forming operations; and to provide shell end design which, in cooperation with the straight side walls, greatly diminishes propagation of noise through the side walls as well as the shell ends.

BRIEF SUMMARY OF THE INVENTION

These and other objects hereinafter appearing have been attained in accordance with the present invention though the discovery of certain cooperating structural design features, which, when incorporated into the upper and lower sections of a hermetic compressor unit shell, markedly reduce objectionable noise emanating from the shell, the invention being defined as a shell for a hermetic compressor unit, said shell having a dome section and lower section, said shell having a unique shape which gives enhanced capacity for absorbing or otherwise attenuating structural and fluid transmitted wave energies emanating from the unit at wave frequencies of between about 1,000 Hz and 2,000 Hz, while reducing total sound power output of the unit, said dome having a generally cylindrical inverted cup-shaped configuration comprising generally cylindrical sidewall means and outwardly curved top means having a central portion surrounded by a peripheral portion, wherein said sidewall means taken in a generally axial direction is substantially straight, wherein said central portion of said top means comprises from about 40 to about 90% of the total area of said top means and has a generally hemispherical configuration on a mean radius of from about 6.5 to about 10.0 inches, and wherein said lower section of said shell has a generally cylindrical sidewall and an outwardly curved bottom wall of a generally hemispherical configuration, the ratio of the radius of curvature of said bottom wall to the largest diameter of the sidewall being from about 0.4 to about 2.0.

In certain preferred embodiments:

(a) the said wave frequencies are from about 1,200 Hz to about 1,800 Hz, and wherein said central portion comprises from about 50 to about 80% of the total area of said top means and is substantially hemispherically outwardly curved on a mean radius of from about 7.5 to about 9.0 inches;

(b) the dome of (a) has a substantially oval shaped cross-section having major and minor axes, wherein the length ratio of the major axis to the minor axis is from about 1.15 to about 1.5;

(c) the dome of (b) is comprised of low carbon steel of a wall thickness of from about 0.090 to about 0.160 inches; and (d) the said peripheral portion of said to means is outwardly curved on a mean radius of from about 1.3 to about 3.5 inches.

DETAILED DESCRIPTION OF THE INVENTION

The invention will be further understood from the following description and drawings which show a preferred embodiment of the present dome in approximately 0.3 scale, wherein.

Figure 10:
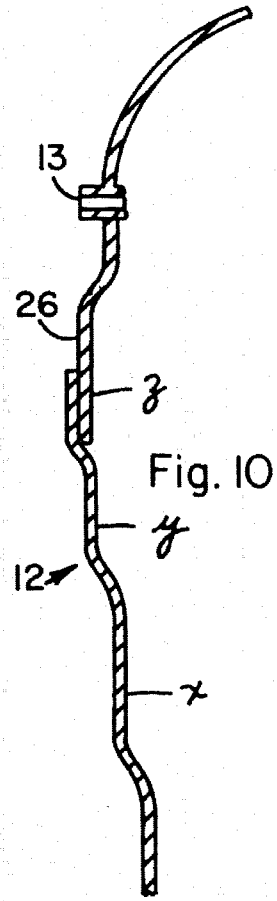
Figure 8:
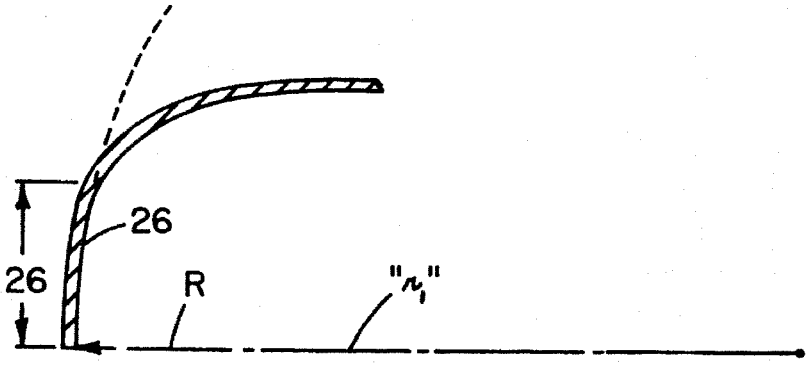
Figure 9:
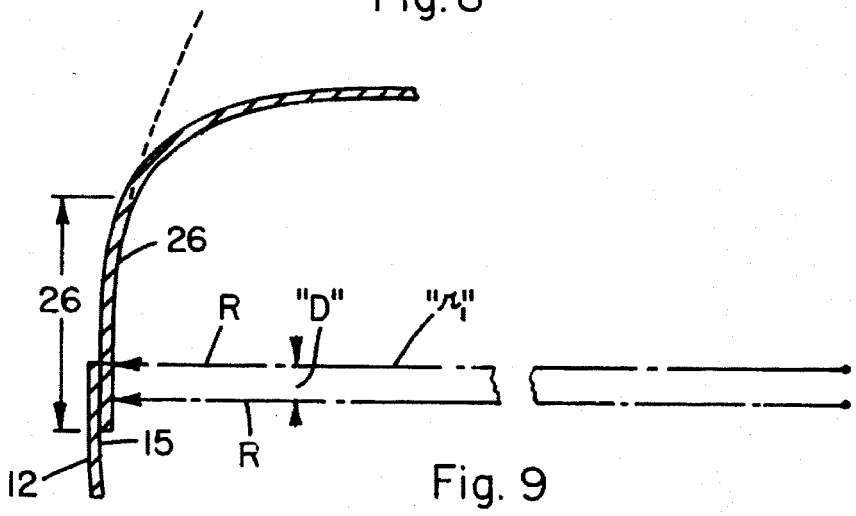

FIG. 8 depicts sidewall 26 as being slightly curved on radius "$r_1$" of from about 35 to about 55 inches;

FIG. 9 depicts both sidewall 26 and the upper portion of the lower shell section 12 being included in this slight curvature, wherein the radius is on line R which has been translated downwardly a distance "D" to include both sidewall 26 and section 12 in the curvature;

FIG. 10 shows the "stepped" type of side wall common to the industry; and

Figure 11:
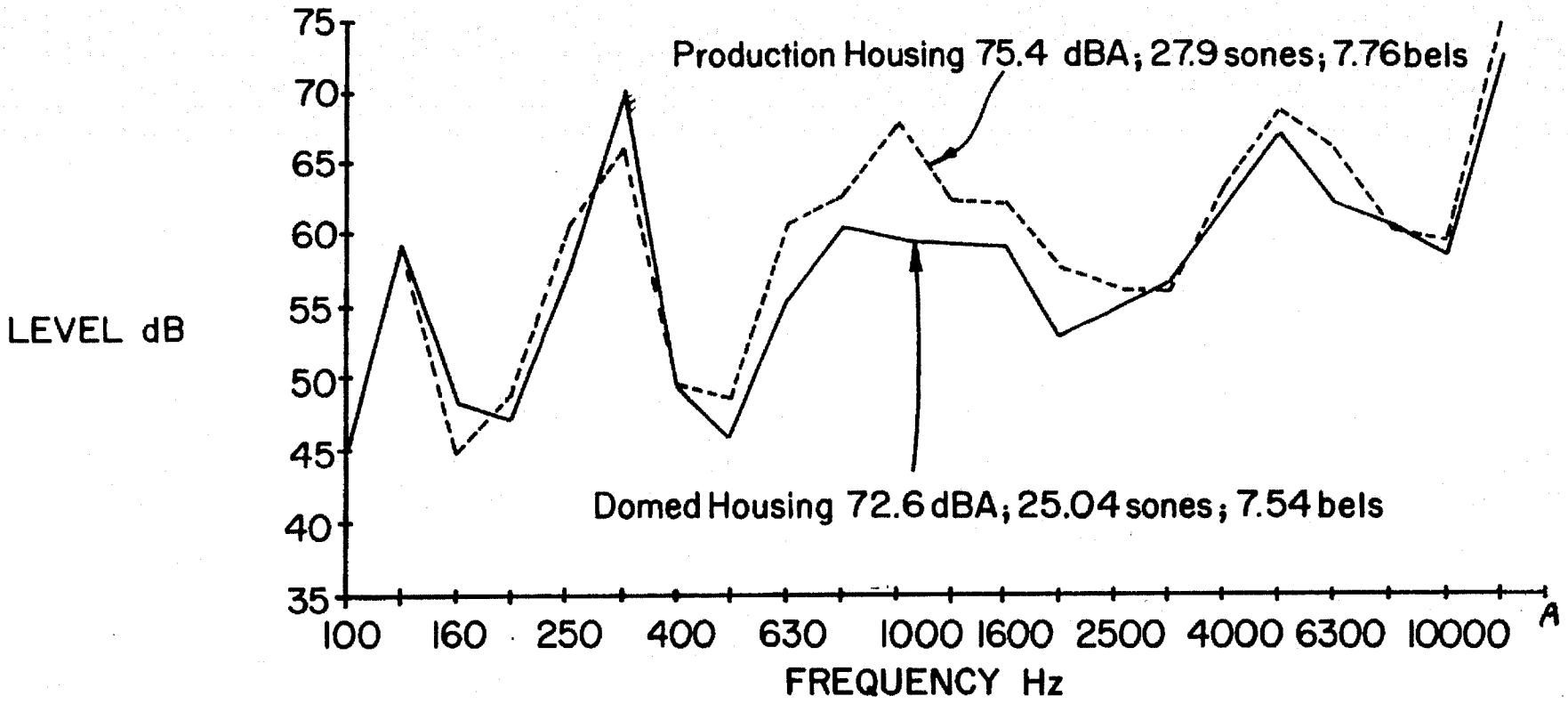

FIG. 11 is a graph comparing a non-domed shell sound noise output in dotted line to that of the present shell shell as shown in solid line.

BRIEF DESCRIPTION OF THE PREFERRED EMBODIMENTS

Referring to the drawing, the present dome generally designated 10, typically formed by a metal drawing operation from low carbon sheet steel of a substantially uniform thickness of from about 0.090 to about 0.160 in., is provided with a suction inlet 11 and discharge outlet 13 and is adapted to nest within a lower shell section such as 12 and be hermetically, peripherally welded thereto as at 14. The shell is dimensioned to contain compressor 16, electric motor 18, and the necessary auxiliary components such as discharge muffler 20, suction line 22, motor cap or suction plenum 24 having inlet 25, and the like. A typical compressor having utility for the present invention is shown in U.S. Pat. No. 4,995,791, the disclosure of which is incorporated herein by reference.

Figure 1:
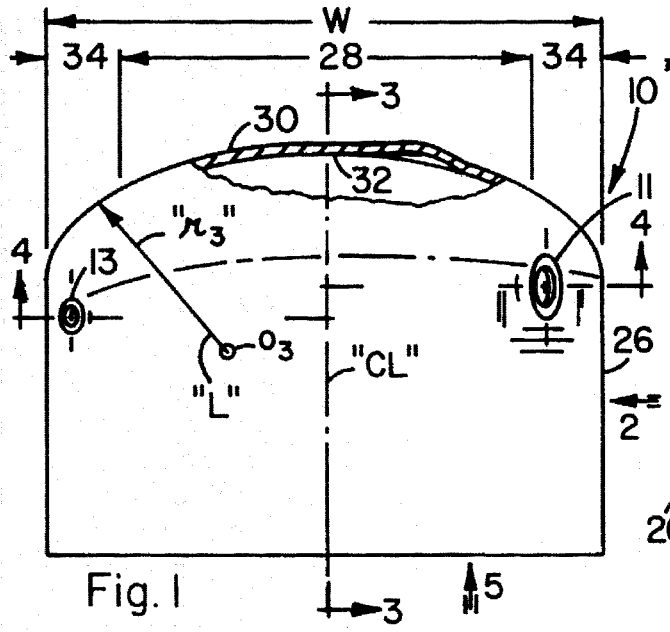
FIG. 1 is a side elevational view, partially sectioned, of the present compressor unit shell dome.
Figure 2:
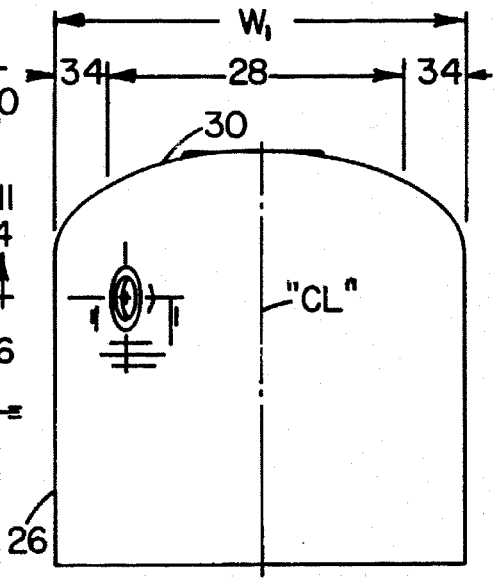
FIG. 2 is an elevational view taken in the direction of arrow 2 in FIG. 1.
Figure 3:
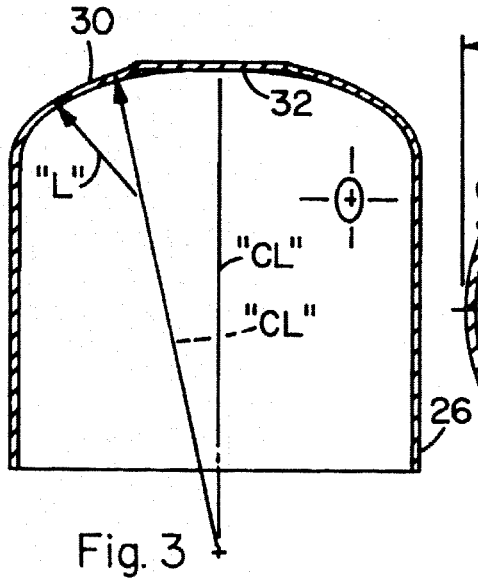
FIG. 3 is a cross-sectional view taken along line 3—3 of FIG. 1 in the direction of the arrows.
Figure 4:
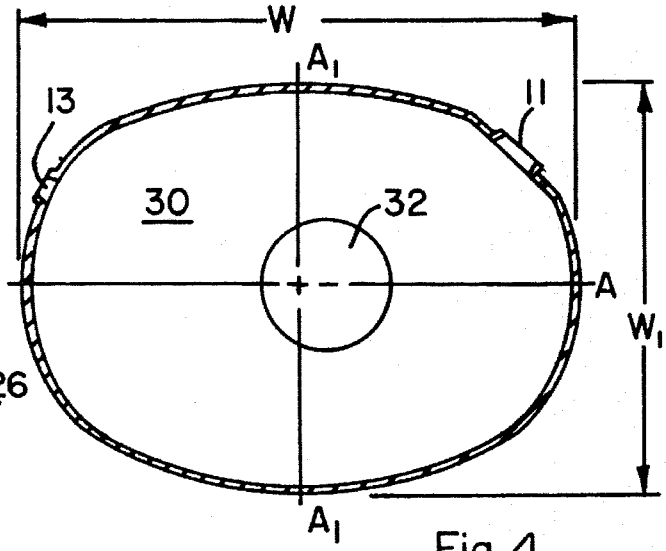
FIG. 4 is a cross-sectional view taken along line 4—4 of FIG. 4—4 of FIG. 1.
Figure 5:
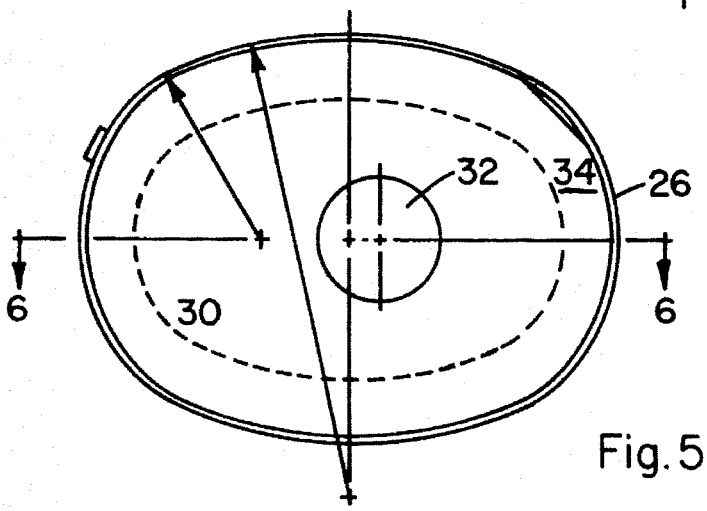
FIG. 5 is a view taken in the direction of arrow 5 in FIG. 1 looking up into the dome.

Dome 10 may have an essentially circular cross-section but most preferably is oval, either of which shapes is termed herein as "generally cylindrical," and has a major axis A—A and minor axis $A_1$—$A_1$, the length ratio along these axes is as indicated in FIG. 4 by the ratio of the dimensions W and W, $W_1$ as being from about 1.0 to about 1.6, and preferably oval of a ratio of from about 1.2 to about 1.5. The sidewall 26 of dome 10 is substantially straight, most preferably, essentially straight, in an axial direction. The term "substantially straight" in this context allows for a slight outward bow on a substantially uniform radius "$r_1$" measured along line R (see FIGS. 6, 8 and 9 of, e.g., from about 35 to about 55 inches, and preferably of from about 40 to about 50 inches. The radius "$r_1$" is measured from origin point $O_1$ should such a bow be desired at all. It is noted that the origin $O_1$ point is located at any peripheral position around the sidewall of the dome, i.e., the radius "$r_1$" is used to define the curvature, if any, of the sidewall 26 of the dome. The length of "$r_1$" can be "substantially uniform" which means that if one wanted to, he could change the length of "$r_1$" for different small segments of wall section 26 for some specific purpose such as spatial requirements, without thereby deviating from the concept of giving a slight bow to wall section 26. It is noted that the upper portion 15 of the lower shell section 12, e.g., the upper ⅓ to ½ of this section, may also be included in the radius "$r_1$", and in such case, the radius line R will preferably be lowered proportionately a distance "D" as shown in FIG. 9 from the position shown in FIG. 8. The term "straight" as used herein means that the side wall of each section may also be "stepped" inwardly one or more times from the open end of the section toward the closed end thereof, i.e., progressively or by steps of decreased diameters as depicted for example, in FIG. 10 as x, y and z. This "stepped" shell wall concept, such as shown in FIG. 10 is common in the compressor art wherein, typically, for the purpose of allowing the shell to be fitted within limited space areas of the refrigeration system, such stepped configurations of the shell are adopted. Such design still accommodates the deep-draw metal forming process.

The radially inner or central portion 28 of top 30 of the dome is outwardly curved in a substantially hemispherical manner and substantially uniformly over at least from about 40% to about 90% of its total surface area which has major and minor width dimensions W and $W_1$ respectively, on a mean radius "$r_2$" of from about 6.5 to about 10.0 inches, preferably of from about 7.5 to about 9.0 inches, taken along center line "CL", i.e., the rotational axis of the compressor from origin point $O_2$ located thereon. It is noted that such upper shell sections, including the present dome, typically are formed with a small, substantially flat area 32 for seating a top stabilizing spring 33 or the like, and such areas and similar ones are, of course, neither dimensionally significant nor inconsistent with the above defined overall substantially hemispherical shape of the present dome top. The outer peripheral portion 34 of the dome top is substantially uniformly curved on a mean radius of "$r_3$" from about 1.3 to about 3.5 inches along a radial line "L" extending normally from an origin point $O_3$ to the tangent of the curved surface of said peripheral portion. The term "mean radius" as used herein denotes the average of all radii of all points on the surface of the curved portion referred to, but not including special surface aberrations or contours such as the aforesaid flat area 32.

Figure 6:
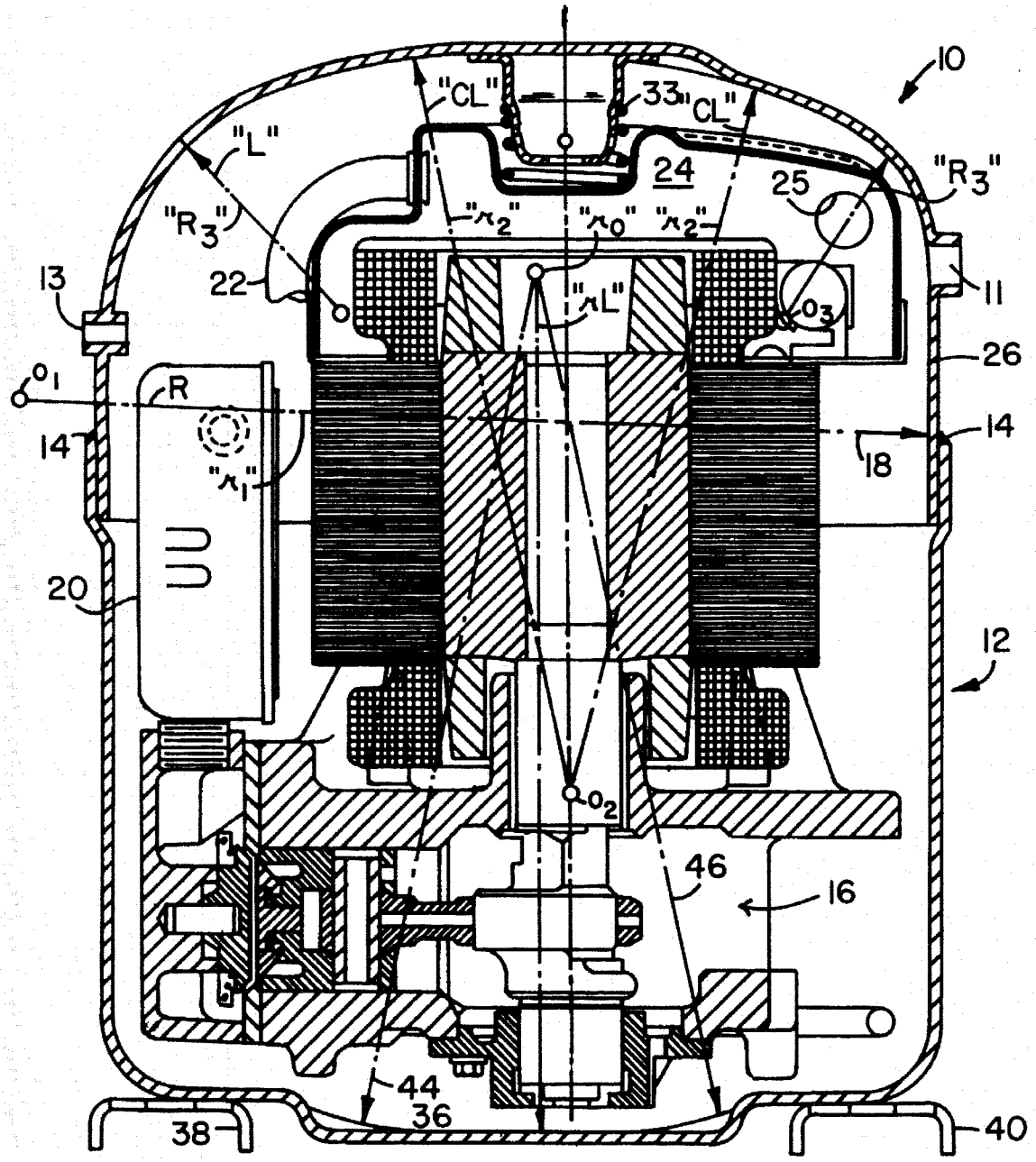
FIG. 6 is a longitudinal cross-sectional view taken along line 6—6 of FIG. 5 of the dome showing the lower section of the shell and portions of the compressor and motor mounted therein in outline, and showning the various radii, i.e., shell curvatures, wherein the radii origins are denoted "0"

The bottom 36 of the lower section is curved, preferably hemispherically, uniformly between the compressor feet 38 and 40, the ratio of the radius of curvature of said bottom wall as measured along and constituting radius line "rL" shown in FIG. 6, to the largest diameter of the sidewall, approximately W shown in FIG. 4, is from about 0.4 to about 2.0, preferably from about 0.5 to about 1.7, and most preferably from about 0.6 to about 1.4. The term "the largest diameter of the side wall", refer to the fact that most compressor shells or housings, including the present, have a major dimension W and a minor dimension $W_1$, each as shown in FIG. 4. The ratio as set forth in certain claims hereof is the length of "rL" from the bottom wall to the radius origin "ro" as shown in FIG. 6, over the major dimension W, i.e., "rL"/W. The radius origin "ro" is located at the apex of the equal length lines 44, 46 emanating from opposite edges of the hemispherical bottom 36.

Figure 7:
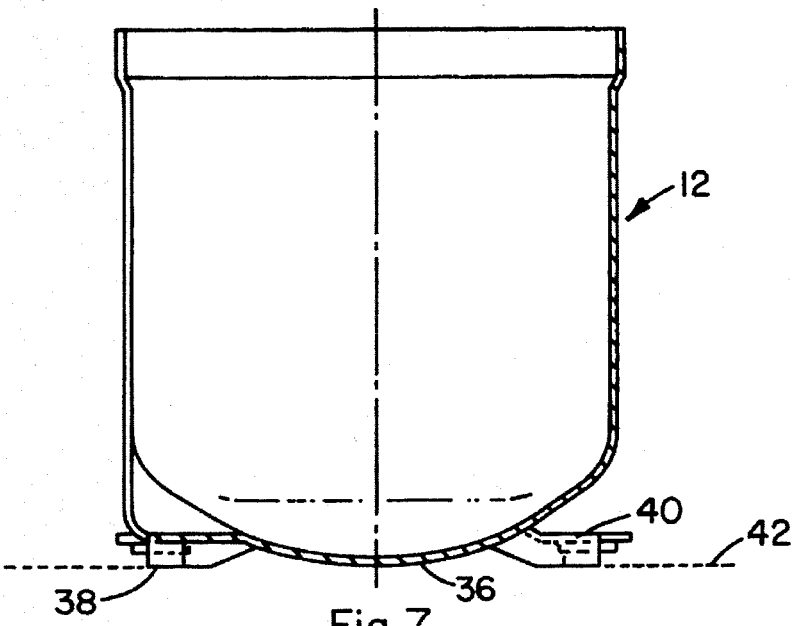
FIG. 7 is a cross-sectional view of a variation of the lower section showing a greater radius for the bottom and a different foot design for accommodating the same.

In FIG. 7, the bottom 36 is shown with a greater outward curvature which is attended by having the compressor feet moved downwardly and inwardly on the bottom to maintain the bottom spaced from the floor line 42.

It has been found that the present particular curvatures in the dome top and lower section bottom, particularly for compressors utilizing domes of approximately three to six times the dimensions shown in the drawing, markedly attenuate offensive compressor unit noise. In this regard, it has been experienced that at the higher wave frequencies, e.g., 2200–2500 Hz, the noise radiation efficiency of the compressor shell is at a lower level and thus the measured sound power is reduced. Conversely, at the objectionable wave frequencies to which the present invention is directed, sound power and wave frequencies are typically at undesirable levels unless the wave energies are attenuated.

This invention have been described in detail with particular reference to preferred embodiments thereof, but it will be understood that variations and modifications will be effected within the spirit and scope of the invention.

We claim:

1. A hermetic compressor unit comprising a shell containing a compressor and motor, said shell having a dome and a lower section, said dome having a shape which gives enhanced capacity for absorbing and attenuating structural and fluid transmitted wave energies emanating from the unit at wave frequencies of between 1,000 Hz and 2,000 Hz, while reducing total operating noise of the unit, said dome being formed of sheet metal and having a generally inverted cup-shaped configuration comprising generally cylindrical sidewall means and top wall means having a central portion surrounded by a peripheral portion, each said wall means having a substantially uniform thickness and providing an inner and an outer surface, said top wall means being outwardly curved in a generally axial direction such that the outer surface thereof is convex, wherein said sidewall means taken in a generally axial direction has a radius of outward curvature of from essentially zero to about 55 inches as measured from an origin point $O_1$, wherein said central portion of said top means comprises from about 40 to about 90% of the total area of said top means and has a generally hemispherical configuration on a mean radius taken on a center line "CL" from an origin point $O_2$ of from about 6.5 to about 10.0 inches, and wherein said lower section of said shell has a generally cylindrical sidewall and an outwardly curved bottom wall of a generally hemispherical configuration, the ratio of the radius of curvature of said bottom wall to the largest diameter of the sidewall being from about 0.4 to about 2.0.

2. The unit of claim 1 wherein said wave energies have wave frequencies of from about 1,200 Hz to about 1,800 Hz, and wherein from about 50 to about 80% of the central area of the dome top means is substantially hemispherically outwardly curved on a mean radius of from about 7.5 to about 9.0 inches as measured from an origin point $O_2$.

3. The unit of claim 2 wherein said dome is comprised of low carbon steel and has a wall thickness of from about 0.090 to about 0.160 inches.

4. The unit of claim 3 wherein said dome is substantially oval shaped in cross-section and has major and minor axes, wherein the length ratio of the major axis to the minor axis is from about 1.2 to about 1.5.

5. The unit of claim 1 wherein said peripheral portion of said top means of said dome is outwardly curved on a mean radius of from about 1.3 to about 3.5 inches as measured from and origin point $O_3$.

6. A shell for a hermetic compressor unit, said shell having a dome, and a bottom section, said dome having a shape which gives enhanced capacity for absorbing and attenuating structural and fluid transmitted wave energies emanating from the unit at wave frequencies of between 1,000 Hz and 2,000 Hz, while reducing total operating noise of the unit, said dome being formed of sheet metal and having a generally inverted cup-shaped configuration comprising generally cylindrical sidewall means and top wall means having a central portion surrounded by a peripheral portion, each said wall means having a substantially uniform thickness and providing an inner and an outer surface, said top wall means being outwardly curved in a generally axial direction such that the outer surface thereof is convex, wherein said sidewall means taken in a generally axial direction has a radius of outward curvature of from essentially zero to about 55 inches as measured from an origin point $O_1$, wherein said central portion of said top means comprises from about 40 to about 90% of the total area of said top means and has a generally hemispherical configuration on a mean radius taken on a center line "CL" from an origin point $O_2$ of from about 6.5 to 10.0 inches, and wherein said lower section of said shell has a generally cylindrical sidewall and an outwardly curved bottom wall of a generally hemispherical configuration, the ratio of the radius of curvature of said bottom wall to the largest diameter of the sidewall being from about 0.4 to about 2.0.

7. The dome of claim 6 wherein said wave energies have wave frequencies of from about 1,200 Hz to about 1,800 Hz, and wherein from about 50 to about 80% of the central area of the dome top means is substantially hemispherically outwardly curved on a mean radius of from about 7.5 to about 9.0 inches as measured from an origin point $O_2$.

8. The dome of claim 7 comprised of low carbon steel and having a wall thickness of from about 0.090 to about 0.160 inches.

9. The dome of claim 8 having a substantially oval shaped cross-section having major and minor axes, wherein the length ratio of the major axis to the minor axis is from about 1.2 to about 1.5.

10. The dome of claim 6 wherein said peripheral portion of said top means is outwardly curved on a mean radius of from about 1.3 to about 3.5 inches as measured from an origin point $O_3$.

* * * * *